United States Patent [19]

Johansson et al.

[11] Patent Number: 4,751,785

[45] Date of Patent: Jun. 21, 1988

[54] RESILIENT RETAINING COIL FOR EXCAVATOR TOOTH

[75] Inventors: Arne Johansson, Karlskoga, Sweden; Jop Amelink, Spaarndam, Netherlands

[73] Assignee: AB Bofors Wear Parts, Bofors, Sweden

[21] Appl. No.: 799,871

[22] Filed: Nov. 20, 1985

[30] Foreign Application Priority Data

Nov. 20, 1984 [SE] Sweden ..... 8405819

[51] Int. Cl.[4] ..... F02F 9/28

[52] U.S. Cl. ..... 37/142 A; 172/713

[58] Field of Search ..... 172/713, 753, 749; 37/142 R, 141 T, 142 A; 403/409.1, 372, 243

[56] References Cited

U.S. PATENT DOCUMENTS

| | | | |
|---|---|---|---|
| 2,259,456 | 10/1941 | Crawford | 37/142 A |
| 2,339,128 | 1/1944 | Younie | 37/142 R |
| 2,904,909 | 9/1959 | Ratkowski | 37/142 R |
| 3,623,247 | 11/1971 | Stepe | 37/142 R |
| 3,832,077 | 8/1974 | Mehren | 37/142 A |
| 3,879,867 | 4/1975 | Ericson | 37/142 A |
| 4,414,764 | 11/1983 | Johansson | 37/141 T |
| 4,625,439 | 12/1986 | Johansson | 37/142 R |

FOREIGN PATENT DOCUMENTS

| | | | |
|---|---|---|---|
| 2930804 | 12/1981 | Fed. Rep. of Germany | 37/142 A |
| 2264140 | 10/1975 | France | 37/142 R |

*Primary Examiner*—Richard J. Johnson

*Attorney, Agent, or Firm*—Pollock, Vande Sande & Priddy

[57] ABSTRACT

The present invention relates to a method of attaching a wear part to an earth-working tool and a thereto adapted wear part. Characteristic of the invention is that the parts are joined together by means of a press fit which in turn is blocked by means of pretensioned resilient locking means which when fitted in place continually act upon the parts in the direction of interconnection. The invention provides a play-free and reliable interconnection for the tool and wear part, which is also very easy to remove.

8 Claims, 4 Drawing Sheets

RESILIENT RETAINING COIL FOR EXCAVATOR TOOTH

FIELD OF THE INVENTION

This invention relates to a method of eliminating the play between the different parts of a mechanically connected wear parts system for earth-working machines and a wear parts system designed in accordance therewith.

BACKGROUND OF THE INVENTION

The term wear part is nowadays widely used within the trade as a general designation of all types of more or less easily replaceable wear protectors and teeth used on soil working implements and tools such as buckets, shredders, cutters, etc. on excavators etc. As a rule, a wear parts system consists of adapters attached to the tool concerned with a greater or lesser degree or permancency and one or a plurality of removable front parts, mechanically attached to each and every one of these adapters, the said front parts being the wear parts proper in the form of teeth, cutting edges etc. The ease with which a wear part of this kind is interchangeable varies with the amount of wear to which it can be expected to be exposed. The teeth protruding in front of the tools are particularly exposed to very heavy wear. These, or their outermost tips, to the extent that these are demountable, are therefore nowadays secured in their adapters by means of an easily removable locking element. Changing a damaged tooth is therefore usually done in a matter of a minute or so. The previously mentioned adapters are often welded to or at the front edge of the tool but they can also be mounted with bolts, wedges or by some other means.

Several different wear parts systems are now available on the market but none of them is completely perfect. The main fault with the majority of these systems is that success has not being achieved in mastering the play that which is mechanically secured in the adapter. As a rule, moreover, this play increases in magnitude with the passage of time and cannot be eliminated by a simple replacement of the wear part, since the contact surfaces of the adapter are gradually worn down because the wear part proper mountd therein moves in the adapters as work is being carried out. Hitherto, it has been economically unfeasible to manufacture wear part system components with such fine tolerances that no initial play occurs since this would have required machining the contact surfaces to narrow tolerances. Wear parts are mass-produced goods which, in order to be sold at competitive prices, must be able to be cast or forged directly to their final dimensions without any subsequent chip-forming machining, with the exception of normal burring operations.

Although wear parts subject to play give rise to strikingly increased wear in the vast majority of earth-working tool types, the wear caused by play is nevertheless decidedly the most in the case of rotary dredging cutters or suction dredging cutters. These are used for bottom work, mainly in coral and limestone or otheer softr species of rock. The actual tool consists of a rotary front portion formed by a plurality of toothed spirally twisted vanes disposed at a certain distance from each other which together form a very large drill bit. This drill bit is subsequently rotated with the teeth of the vanes in direct engagement with the bottom rock which is to be worked, at the same time as water is continuously sucked in between the rotating vanes and removed from the point of work. By this means, continuous disposal of broken rock and other bottom sediment is accomplished. The wear parts for such earth-working tools are exposed to extremely heavy wear in their points of attachment on account of the vibrations in the tool and because the tool constantly works in a slurry of sand, clay and/or other abrasive particles. The object of the present invention is to offer a solution to this problem, primarily intended for such dredging cutters but also applicable to every other place where there is a need for wear parts which are seated entirely without play, cannot be loosened by vibrations and are nevertheless very easy to replace.

SUMMARY OF THE INVENTION

According to the invention, the joint between the tooth and the adapter is designed as a self-impeding press fit which is blocked against vibrating apart by means of a spring-tensioned resilient blocking means which constantly presses the parts against each other. A further characteristic of the device according to the invention is that the contact surfaces betwen wear part and adapter are designed in such a manner that these not only give rise to a press fit byt are also pressed against each other by the normal machining forces acting on the wear part. In order to afford a press fit also between cast or forged, otherwise unmachined surfaces and surfaces which have only been given the least possible machining after casting or forging, one of the two interconnection parts, the mal portion, has been made solid and non-resilient, while the other interconnection part, the female portion, has been elaborated with such a wall thickness that the material properties of the actual material used, in most cases steel, imparts to this a certain elasticity so that the contact surfaces of the female portion, as closely as possible, mate with the contact surfaces of the male portion whent he portions are forced together with a certain force, e.g. when the parts are stuck together by one or several blows with a sledge hammer or similar tool. As intimated by the designation male portion, this consists of a protruding nose orthe equivalent, whereas the female portion consists of a recess or cavity. If a press fit between the members is to be obtainable at all, it is necessary for the male and female portions to be elaborated with suitable clearancee angles and adpated to each other. A forward tapering towards the tip of the male portions giving a tip angle of 5°–15°, preferably around 10°, is then necessary. At the same time,it has been found appropriate to elaborate the male and female portions with at least three contact surfaces angled relative to each other as a three-point contact or perhaps rather three-line contact all the way around. The cross-sections of the respective members may then have the form of a parallel trapezoid with contact between them along the base and the two inclined side edges and clearance in the corners and along the shorter upper edge. To prevent the press fit which is obtained when the portions are stuck together from vibrating apart, special resilient locking means are fitted between locking surfaces disposed opposite to each other in the respective member. At the same time, as the locking means are brought down into their locking positions, they are pretensioned so that once in place they continuously press the members together with a certain specific spring force. A suitable location of the applying the locking means has been found to be across each and every one of the sides forming the two inclined edges of the parallel trapezoidal cross section. Half the space for the locking means is then located in each part in such a manner that the parting line between the space located in each part runs diagonally through the rectangular cross section of the total space.

One type of locking means which has proved to be highly functional since it is simple to manufacture and can be given a powerful pretension is a resilient wire rebent in one plane which has been bent so as to have two or more shanks running longitudinally at a distance from each other, the outer edges of the rebent in the unloaded state being located further from each other that the distance between the oppositely located locking surfaces in the interconnected female and male portions. When the locking means has more than two longitudinal shanks, are located spirally inside each other. The distance between these shanks along the long sides of the locking means is then appropriately chosen in such a manner that the more the outer shanks are pressed towards each other, the more the shanks disposed inside each other are brought into contact with and interact with one another. The outer contour of the locking means can be made in the form of an extended ellipse or with one largely straight longitudinal shank and one arc-shaped longitudinal shank. The locking means can be bent from spring wire of round or rectangular cross section. The last inner shank can be terminated with a rebending which in principle implies a total stop for the compression of the locking means. As the locking means is pressed down into place, it is pretensioned at the same time and thus provides reliable locking of the press fit, which it continually acts upon in the direction of interconnection. When the locking means have been removed, for instance by being forced out of the locking position with the aid of an arbor,the press fit can be broken by striking the parts apart with a sledge hammer.

The invention is defined in the accompanying claims and will now be described in greater detail and with reference to the accompanying drawings, wherein:

BRIEF DESCRIPTION OF THE DRAWINGS

FIG. 5 shows the tooth tip included in the wear parts system according to the invention seen along section II—II in FIG. 1, while

DETAILED DESCRIPTION OF THE INVENTION

Figure 1:
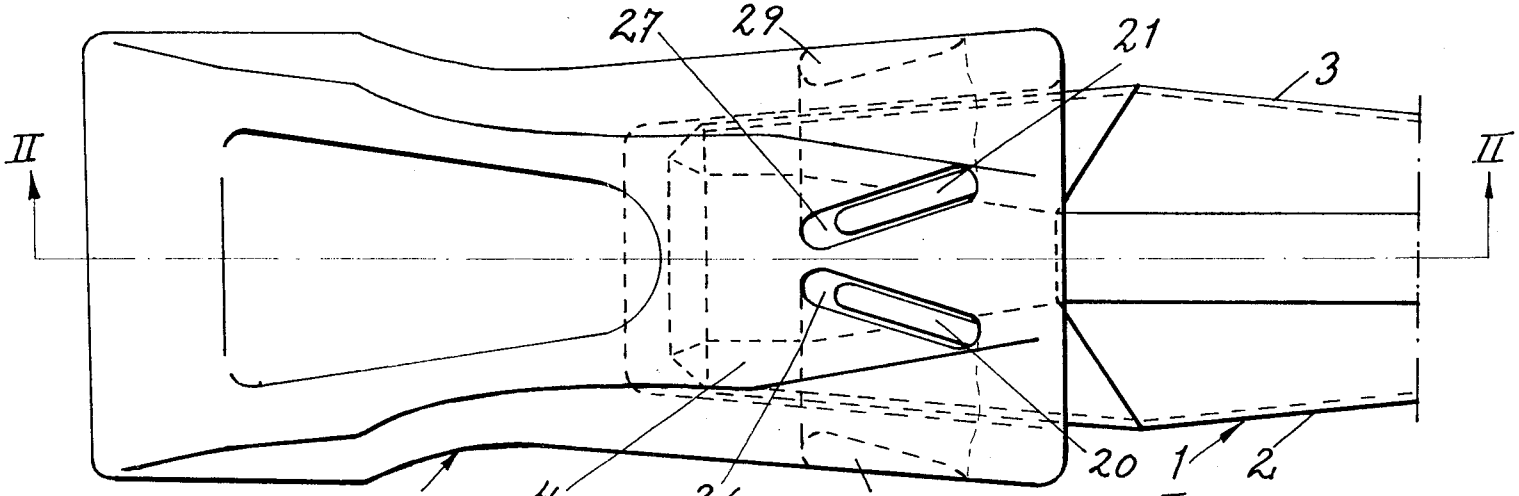
FIG. 1 shows a vertical view of a wear parts system according to the invention.

The wear parts system illustrated in the figures consists of an adapter 1, the rear outer portion of which has been dispensed with since it is of less interest in the present context. The adapter 1 is intended to be welded to the tool in question along the edges 2 and 3. The adapter 1 is also provided with a male portion 4, protruding forwards in the working direction, in this case to the left in the illustration. This male portion 4 supports a tooth tip or actual wear part 5. The wear part 5 displays a recess or female portion which in the fitted condition is passed over the male portion and secured to this means of a self-impeding press fit accomplished by driving the wear part onto the male member portion by means of one or several blows with a sledgehammer against the tip. The press fit is broken in a corresponding manner by striking it loose, directing the blows towards the edge 7 surrounding the female portion 6. The upper edge 8 of the adapter 1 can then be used as a guide for the sledgehammer.

The male portion 4 is solid whereas the material surrounding the female portion 6 is no thicker than that of the material in the wear part impart a little elasticity which contributes towards good contact against the male portion. Both the male and the female portion taper off forwards with a nose angle of around 10°.

Figures 6, 7:
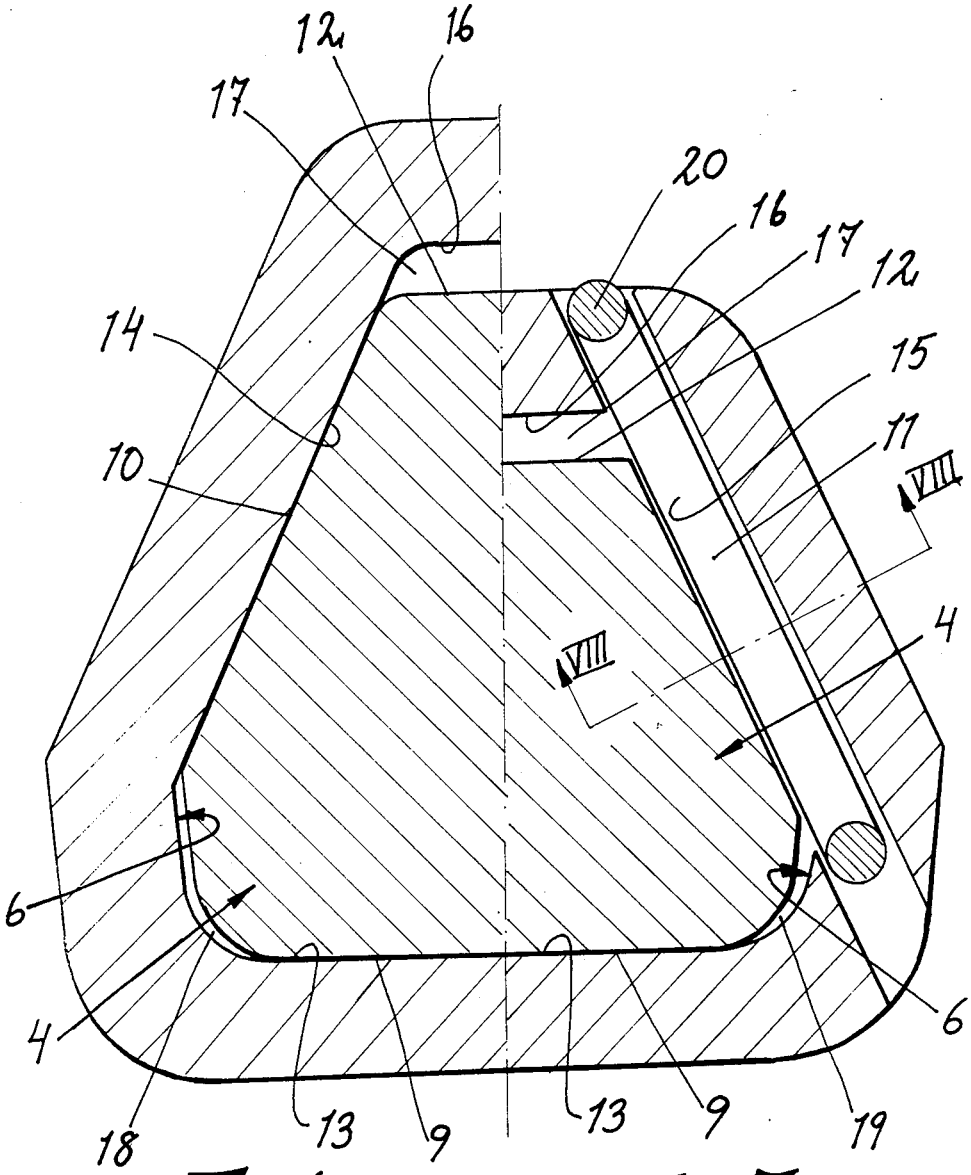
FIGS. 6 and 7 show on a double scale the left-hand portion and right-hand portion respectively of sections VI—VI and VII—VII in FIG. 2 and, finally.

As evident from FIGS. 6 and 7, in particular, both the male portion 4 and the female portion 6 have also a largely parallel trapezoidal cross-section where the base and the inclined edge sides afford the press fit between the portions, whereas there is a clearance along the shorter top side and at the lower corners which have been thoroughly bevelled off. In the figures, these components have been given the following reference numerals: the male portion base edge 9, its two inclined side edges 10 and 11 respectively and its top edge 12. The female portion base edge 13, its two inclined side edges 14 and 15 respectively and its top edge 16. The clearance at the top is designated by reference numeral 17 and at the corners by reference numerals 18 and 19 respectively.

To prevent the press fit from vibrating loose it is possible to apply two resilient locking means 20 and 21 in two locking seats provided for this purpose which run across the inclined side edges of the male and female portions respectively.

Figure 9:
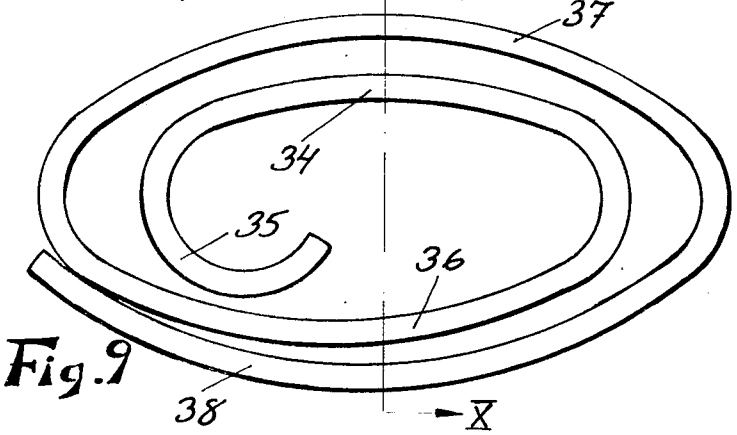
Figure 10:
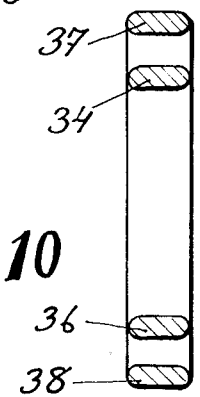
Figure 2:
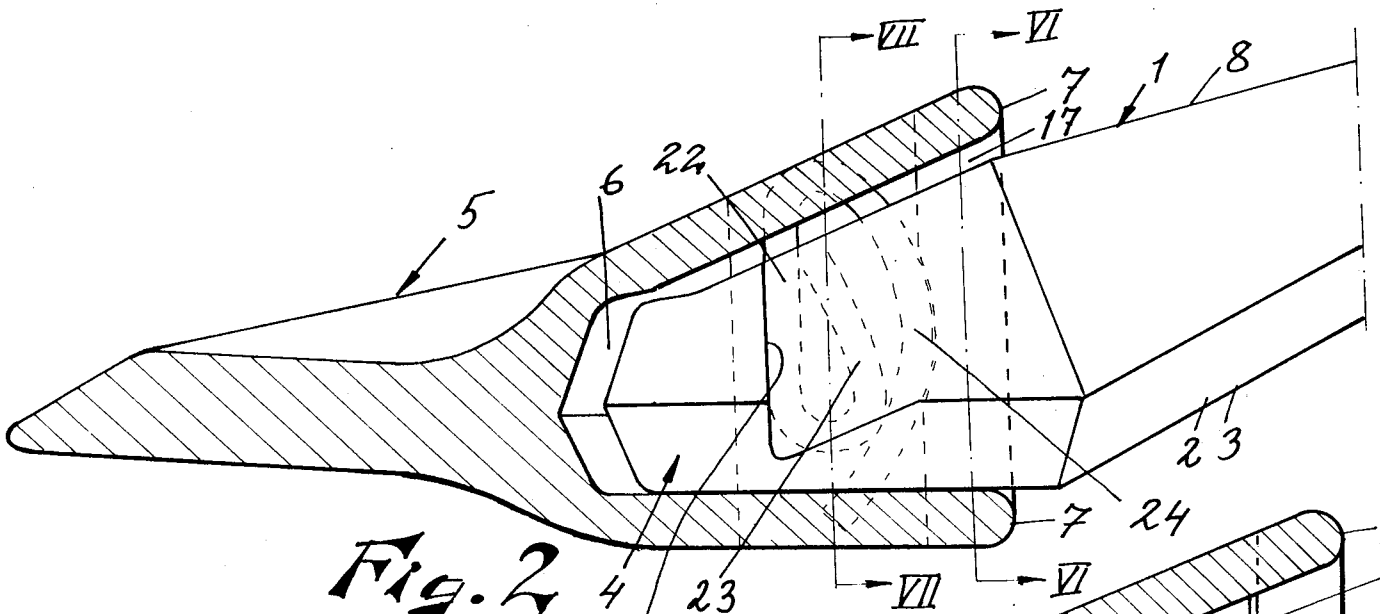
FIG. 2 shows a section along the line II—II in FIG. 1, FIGS. 3 and 4 show a side projection and vertical view, respectively, of the adapter included in the wear parts system.
Figure 5:
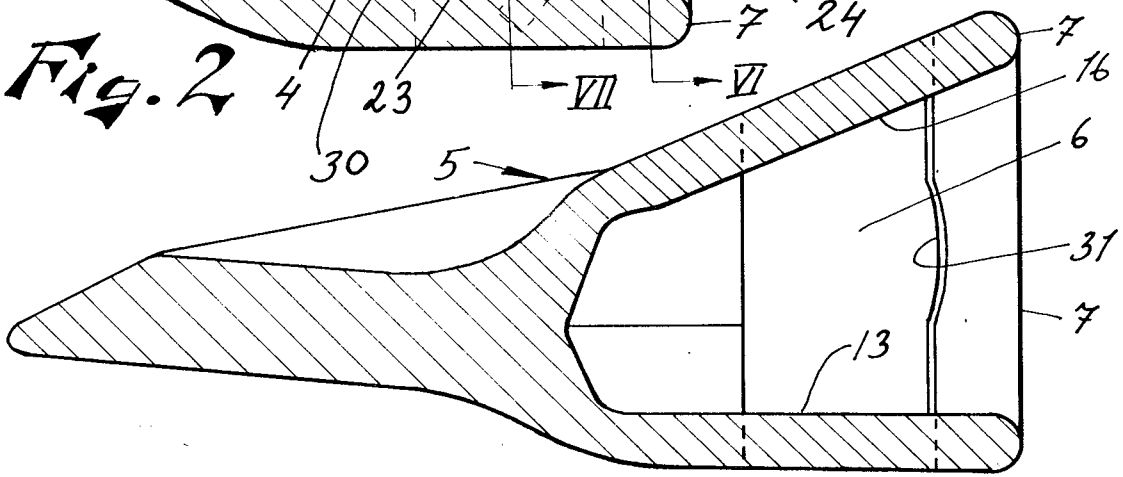
Figure 3:
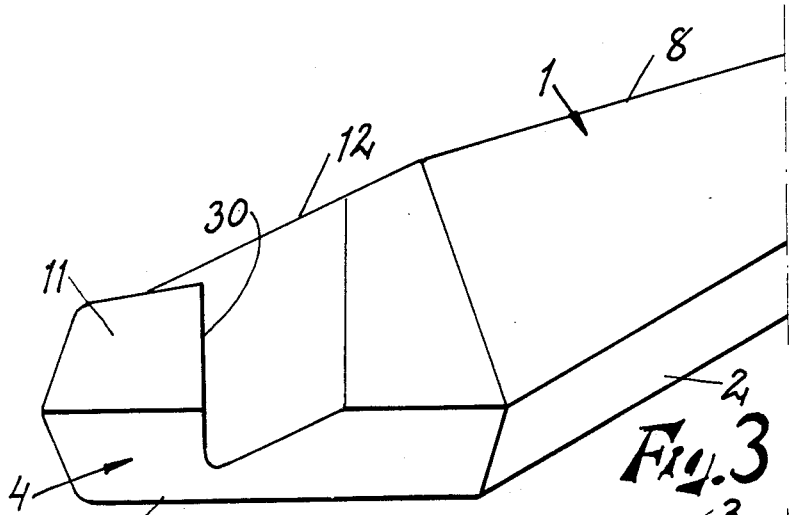
Figure 4:
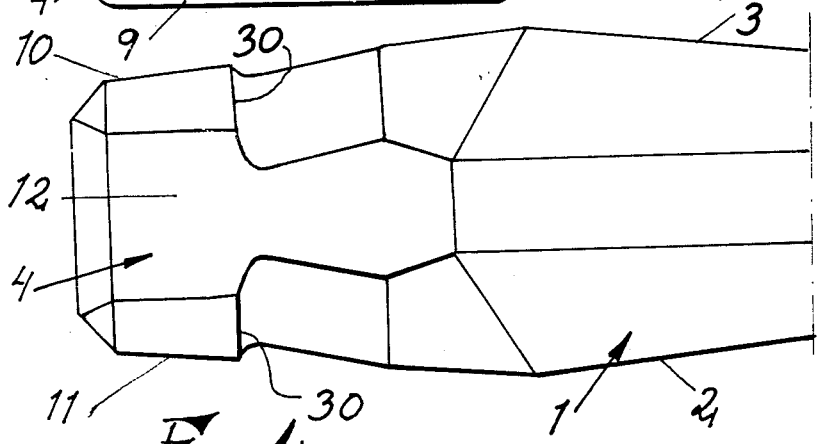

Such a locking means can have one of the forms illustrated in FIG. 2 and in FIGS. 9 and 10 or any other form which falls within the definition given in the claims. In purely longitudinal shanks of bent spring wire of optional cross-section. The locking means according to FIG. 2 consists of a spring wire bent in one plane, the middle largely straight portion of first shank 22 of which has been rebent in one end a good 180° into a second shank 23 which is bent inwards towards the first shank 22. In its other end, the shank 22 is bent not fully 180° to an arc-shaped third shank 24 which towards its outer end rests against the rebending towards the second shank 23. The locking means are forced, when the wear part has been fitted, through locking apertures 26, 27 in the upper side of the wear part 5 down to their respective locking seats on either side of the male portion. In their locking seats they are clamped between locking surfaces in the male and female portion respectively. In the underside of the wear part 5 are apertures 28, 29 through which the locking means can be struck out when the wear part is to be removed.

The locking means according to FIGS. 9 and 10 consist of a first longitudinal slightly arc-shaped shank 34 which in its free inner end, has been rebent to a stop cam 35 which limits the total compression of the locking means and which, in its other end, via a smaller radius of curvature, has been rebent to a second longitudinal shank 36 arc-shaped in the opposite direction which, via a new rebending with a small radius, passes into a shank 37 lying beyond shank 34 which via a further spiral-shaped rebend with a small radius is transformed into the shank 38 located beyond shank 36 which in its free outer end rests against the shank 36. When the outer shanks 37 and 38 of the locking means are pressed against each other, e.g. when the locking means is moved down to the respective locking seat through any of the locking apertures 26 or 27, the shanks 37 and 38 will be pressed against the shanks 34 and 36 which will then also be incorporated in the function. A locking means of this type can give a fairly long path of resilience at the same time as it will be very strong. As previously pointed out, all the rebendings have been done in the same plane so that the locking means is flat.

Figure 8:
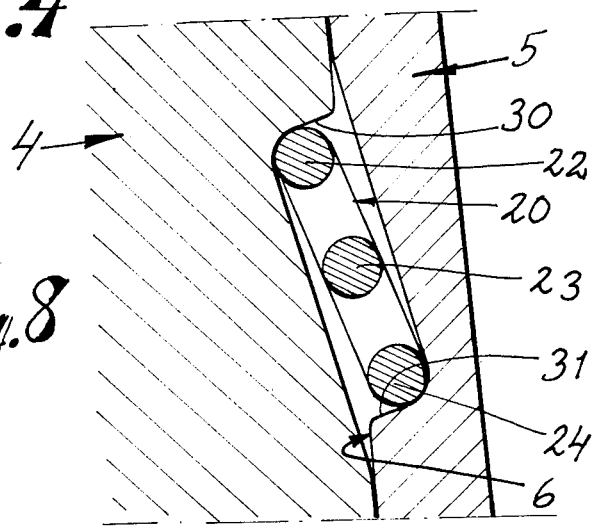
FIG. 8 shows section VIII—VIII in FIG. 7, and FIGS. 9 and 10 show a further type of resilient locking means in side projection and cross section (double scale).

FIGS. 2, 7 and 8 illustrate a locking means made of a spring wire of round cross section whereas FIGS. 9 and 10 illustrate a locking means made of a resilient wire of largely rectangular cross-section with rounded lateral edges. Both types of locking means fit into the same locking seats.

The aforesaid locking seats are formed by opposing locking surfaces 30, 31 in the male and female portion respectively and recesses in the respective portion corresponding to half the space for the respective locking element. The space required for locking means is of rectangular cross-section (see FIG. 8) and the recesses 32, 33 have been designed so that the parting line between them runs diagonally through this cross-section.

As evident from FIG. 1 the locking surface 31 has been given a central recess 34 which is adapted to the arc-shaped part 24 or alternatively 37 or 38 of the locking means.

The distance between the locking surfaces 30 and 31 is less than the normal distance between the shanks 22 and 24 or alternatively 37 and 38 of the locking means 20, 21. This implies that the locking elements are pretensioned when they are forced down between the locking surfaces. Here, it is a matter of relatively stout spring steel in the locking means which, in the locking seat, act upon the members with spring forces of 200 kp or more.

We claim:

1. A wear parts system for earth-moving machines comprising:

first means having a solid, non-resilient male portion tapered towards its outer end with at least three first longitudinal contact surfaces inclined relative to each other in a lateral direction thereacross, the male portion having first peripherally disposed locking surfaces;

second means having a female portion pressed to the first means for forming a self-impeding press joint between the male and female portions, the female portion expanding toward its outer end with second contact surfaces corresponding respectively to the first longitudinal contact surfaces of the male portion for cooperating therewith, respective angles being selected between the corresponding first and second contact surfaces for imparting a self-impeding press fit therebetween when the surfaces are pressed together, the female portion having second locking surfaces, the female portion being made from a material having an elasticity and a material thickness, the material thickness being such that the elasticity of the material eliminates minor irregularities between the corresponding contact surfaces when the first and second means are forcibly pressed together, the second locking surfaces being positioned opposite to the first locking surfaces;

unitary resilient coil-like locking means being interposed between the locking surfaces under pretension continuously acting upon the male portion and the female portion, the locking means being clamped by the locking surfaces, the locking means continuously acting upon the first and second means in the direction of interconnection, the locking means having a widest portion and a narrower portion, the locking surfaces of the male portion facing the widest portion and the locking surfaces of the female portion facing the narrower portion of the locking means;

whereby the press joint is secured against vibrations that would otherwise have been able to separate the first and second means.

2. A wear parts system according to claim 1, wherein the male and female portions each have a substantially parallel trapezoidal cross-section the two inclined edge sides and base of which form the contact surfaces; and wherein when the portions are interconnected, respective clearances are effected between portions at the corners of the cross-section and along respective top edges thereof.

3. A wear parts system according to claim 1, wherein the locking surfaces for the locking means are recessed in the male and female portions and wherein half the space required for the respective locking means is designd as a recess in the part concerned.

4. A wear parts system according to claim 1, wherein the resilient locking means comprises a resilient wire bent in one plane into at least three longitudinal spiral-shaped shanks disposed outside each other.

5. A wear parts system according to claim 4, wherein the longitudinal shanks of the locking means are arc-shaped and have convex sides facing the outer longitudinal edges of the locking means, the longitudinal shanks successively passing over each other at the ends of the locking means via rebent cams with smaller radii than the arcuate shape of the shanks, the longitudinal shanks being disposed primarily along the outer longitudinal edges of the locking means with a distance between the outer shanks in an unloaded condition exceeding the distance between the locking surfaces in fitted male and female portions; and wherein the distance between adjacent shanks is no greater than that of the outer shanks when the locking means compressed to pretension are pressed in towards the nearest inside located shanks and are supported by the same.

6. A wear parts system according to claim 4, wherein the rebent resilient wire forming the locking means is of rectangular cross-section.

7. A wear parts system according to claim 1, wherein the male and female portions have respective longitudinal tip angles.

8. A wear parts system according to claim 1, wherein the contact surfaces of the male and female portions are so angled relative to each other that the contact forces between the surfaces intersect each other approximately about a line marking the center of gravity for each cross-sectional area of the male portion.

* * * * *